US006690018B1

(12) United States Patent
Barone

(10) Patent No.: US 6,690,018 B1
(45) Date of Patent: Feb. 10, 2004

(54) MOTION DETECTORS AND OCCUPANCY SENSORS WITH IMPROVED SENSITIVITY, ANGULAR RESOLUTION AND RANGE

(75) Inventor: Stephen Barone, Dix Hills, NY (US)

(73) Assignee: Electro-Optic Technologies, LLC, Dix Hills, NY (US)

( * ) Notice: Subject to any disclaimer, the term of this patent is extended or adjusted under 35 U.S.C. 154(b) by 0 days.

(21) Appl. No.: 09/830,594

(22) PCT Filed: Oct. 27, 1999

(86) PCT No.: PCT/US99/25161

§ 371 (c)(1),
(2), (4) Date: Jul. 18, 2001

(87) PCT Pub. No.: WO00/26879

PCT Pub. Date: May 11, 2000

Related U.S. Application Data

(60) Provisional application No. 60/106,323, filed on Oct. 30, 1998, and provisional application No. 60/143,209, filed on Jul. 9, 1999.

(51) Int. Cl.[7] ..... G08B 13/193

(52) U.S. Cl. ..... 250/353; 250/347

(58) Field of Search ..... 250/353, 347, 250/342, 349, 221, 222.1, DIG. 1

(56) References Cited

U.S. PATENT DOCUMENTS

| | | | |
|---|---|---|---|
| 3,036,219 | A | 5/1962 | Thompson |
| 3,524,180 | A | 8/1970 | Cruse |
| 3,631,434 | A | 12/1971 | Schwarz |
| 3,703,718 | A | 11/1972 | Berman |
| 3,886,360 | A | 5/1975 | Reiss et al. |
| 3,958,118 | A | 5/1976 | Schwarz |
| 4,122,427 | A | 10/1978 | Karsh |
| 4,321,594 | A | 3/1982 | Galvin et al. |
| 4,342,987 | A | 8/1982 | Rossin |
| 4,404,468 | A | 9/1983 | Kleinschmidt |
| 4,420,688 | A | 12/1983 | Le Bars |
| 4,429,223 | A | 1/1984 | Wagli |
| 4,429,224 | A | 1/1984 | Wagli et al. |

(List continued on next page.)

FOREIGN PATENT DOCUMENTS

| | | | | |
|---|---|---|---|---|
| CA | 2315846 | * | 2/2003 | ..... G02B/7/02 |
| DE | 3615946 | A1 | 11/1987 | |
| DE | 87 12 893.4 | | 1/1988 | |
| DE | 390676 | A1 | 9/1989 | |
| DE | 3803277 | A1 | 9/1989 | |
| EP | 0 050 750 | | 5/1982 | |
| EP | 0 050 751 | | 5/1982 | |
| EP | 0 256 651 | | 2/1988 | |
| EP | 0 358 929 | | 3/1990 | |
| EP | 0 501 253 | A | 9/1992 | |
| GB | 2 299 405 | | 10/1996 | |
| JP | 54 998 | | 1/1979 | |
| JP | 3 95480 | | 4/1991 | |
| JP | 06294865 | | 10/1994 | |
| WO | WO 88 04038 | A | 6/1988 | |
| WO | WO 92/10819 | | 6/1992 | |
| WO | WO 93 19385 | | 9/1993 | |
| WO | WO 98/11521 | | 3/1998 | |
| WO | WO 99/40453 | | 8/1999 | |

*Primary Examiner*—David Porta
*Assistant Examiner*—Otilia Gabor
(74) *Attorney, Agent, or Firm*—Carter, DeLuca, Farrell & Schmidt, LLP

(57) ABSTRACT

Apparatus for improving the sensitivity, angular resolution and range of motion detectors, occupancy sensors and similar systems include an improved infrared input section which employs at least one additional lens, possibly segmented, before a lens array. This pre-focusing lens collects and at least partially focuses incident infrared radiation onto at least one element of the lens array. The lens array focuses the radiation onto a detector.

30 Claims, 17 Drawing Sheets

U.S. PATENT DOCUMENTS 4,442,359 A 4/1984 Lederer
4,604,524 A * 8/1986 Kotlicki et al. ..... 250/342
4,661,720 A 4/1987 Cameron, Jr. et al.
4,663,521 A 5/1987 Maile
4,768,020 A 8/1988 Chen
4,779,240 A 10/1988 Dorr
4,876,445 A 10/1989 McMaster
4,912,331 A 3/1990 Owers
4,978,843 A 12/1990 Yamakama
5,189,393 A 2/1993 Hu
5,266,807 A 11/1993 Neiger
5,308,985 A 5/1994 Lee
5,406,083 A * 4/1995 Sandell et al. ..... 250/353
5,453,622 A * 9/1995 Sandell et al. ..... 250/353
5,491,467 A 2/1996 Tracy et al.
5,557,106 A * 9/1996 Ioco ..... 250/353
5,640,143 A 6/1997 Myron et al.
5,757,004 A * 5/1998 Sandell et al. ..... 250/347
5,764,146 A * 6/1998 Baldwin et al. ..... 340/567
5,834,765 A * 11/1998 Ashdown ..... 250/221
5,886,821 A * 3/1999 Sohn ..... 359/619
5,915,332 A 6/1999 Young et al.
5,929,445 A 7/1999 Barone
6,324,008 B1 * 11/2001 Baldwin et al. ..... 359/619
2003/0006366 A1 * 1/2003 Alden ..... 250/216

* cited by examiner

MOTION DETECTORS AND OCCUPANCY SENSORS WITH IMPROVED SENSITIVITY, ANGULAR RESOLUTION AND RANGE

This application is a 371 of PCT/US99/25161 filed Oct. 27, 1999 which claims benefit of Prov. No. 60/106,323 filed Oct. 30, 1998, which claims benefit of Prov. No. 60/143,209 filed Jul. 9, 1999.

BACKGROUND OF THE INVENTION

1. Field of the Invention

The present invention relates to passive infrared motion detectors, occupancy sensors and similar devices, and more particularly to the infrared input section of these devices.

2. Description of the Related Art

Passive infrared motion detectors and occupancy sensors employ an array of Fresnel lenses covering an entrance aperture. This lens array is illuminated by thermal infrared radiation from the object of interest. For any particular angle of incidence each of the elements in the array of Fresnel lenses covering the entrance aperture generates a focal spot. The array of Fresnel lenses is designed so that as the object of interest moves across its field of view the system of focal spots moves across the sensitive area of a detector. The varying electrical output signal generated by the detector is processed to yield information about the state of motion of the object of interest.

Each element of the array of Fresnel lenses is designed to focus incident infrared radiation in a small angular range onto the sensitive area of a detector. The angular sectors, in which the elements of the array of Fresnel lenses focus onto one of the active areas of a detector, are interlaced by angular sectors which are not focused onto any sensitive area of any detector by any element of the array of Fresnel lenses. Moving infrared radiators are detected when they move from one angular sector across a boundary into an adjacent angular sector, leading to a rapid change in the amount of infrared power falling on the active area of a detector. Ordinarily all of the sectors are of the same angular size so that the maximum angle through which an object of interest can move without being detected, i.e. the angular resolution of the system, is equal to the angular size of one of these sectors. This assumes that the size and velocity of the radiating object and its distance from the entrance aperture are such that the infrared signal is greater than the minimum that can be detected by the system electronics.

One way to improve the angular resolution of the system is to increase the number of elements in the lens array. More specifically, the angular resolution of the system is approximately inversely proportional to the number of elements in the lens array. Thus, in order to achieve the smallest angular resolution, a lens array with as many elements as possible must be employed. On the other hand, the sensitivity and effective range of the system decrease if the size of the individual lenses of the array is decreased. The phrase "sensitivity of the system" refers to the size of the smallest radiating object that can be detected as a function of its distance from the detector. Thus, compromises must be made between the size of the entrance aperture, sensitivity, range and angular resolution of the system. For example, for any desired sensitivity and range there is a minimum size for each of the individual lenses of the array and hence a maximum number of elements for an entrance aperture of fixed size and a corresponding minimum angular resolution. The terms "focus" and "focusing" as used herein are intended to embrace any change in spot size and thus includes partially focusing and defocusing (e.g. dispersing energy).

SUMMARY OF THE INVENTION

The present invention is a new input lens configuration which can be employed, for example, to: 1) increase the sensitivity and range of motion detectors and occupancy sensors with an entrance aperture of fixed size without decreasing the angular resolution of the system or, 2) improve the angular resolution of a system with an entrance aperture of fixed size without decreasing the sensitivity or range of the system or, 3) decreasing the size of the entrance aperture required for a given sensitivity, range and angular resolution, or 4) reduce the distance that the unit must protrude in, for example, a wallbox installation in order to achieve acceptable performance at wide angles. In one implementation the angular resolution of the system is reduced to zero, i.e. moving infrared radiators anywhere in the field of view of the system are detected, not just radiators that cross the planes separating a sequence of angular sectors. The relative importance of each of these characteristics of motion detectors and occupancy sensors depends on the application in which the system is employed.

Two-dimensional implementations of the input lens configuration disclosed herein in wallbox installations, for example, have the capability to detect vertical motion as well as horizontal angular motion. Further, such systems can detect horizontal radial motion (e.g. motion directly towards or away from the detector) which is not possible with prior art systems which can only detect infrared radiators moving across the planes which separate a sequence of angular sectors. It is also possible to design two-dimensional systems which can determine the angular size and range of infrared radiators. This is useful in systems which must filter out signals due to various infrared noise sources.

In simplest terms, the infrared input section disclosed herein consists of a lens array, which may be similar to the Fresnel lens array used in the prior art, preceded by one or more, possibly segmented, pre-focusing lenses, which may or may not be Fresnel lenses. For the purpose of illustration, suppose that a certain range and angular resolution can be achieved by employing some particular lens array. If the number of elements of this array is doubled, for example, the angular resolution is improved by approximately a factor of two. However, without changing the size of each element, so as not to affect the sensitivity or range of the system, the size of the array is doubled. This doubling in size can be avoided by employing a pre-focusing lens in front of the customary lens array to focus the beam from any particular incident direction to say, one-half or less of the size of an original lens element. With this configuration the number of elements in the lens array can be effectively doubled, with a corresponding improvement of the angular resolution by a factor of two, without increasing the total size of the lens array or decreasing the sensitivity or range of the system.

In fact, in the above example, both the sensitivity and range of the system are increased as almost all of the infrared power entering the entrance aperture is focused onto the sensitive area of a detector, rather than only the infrared power entering one element of a lens array as in prior art configurations. In other words, in the prior art the infrared power incident on the entrance aperture is focused into many spots, only one of which is effective in activating a detector when the infrared radiator of interest is in a certain angular sector. This is to be contrasted with the input configuration disclosed herein in which there is a single focal spot which contains almost all of the infrared power incident on the entrance aperture. In this situation the amount of infrared power incident on the detector is larger than that incident on the detector in the prior art configurations by a factor approximately equal to the number of elements in the lens array. For some applications the optimum design will employ a small array of pre-focusing lenses as opposed to a single element. It should be noted that depending on the performance characteristics desired, the lens array may be positioned on either side of or in the focal plane of the pre-focusing lens. Further, again depending on the desired performance characteristics, some of the individual elements of the lens array may be converging while others are diverging, neutral or absent.

With a high degree of pre-focusing, the size of the individual lens elements making up the final lens array preceding the detector may become too small to be realized by current Fresnel lens technology. In this situation microlens and diffractive optics technology can be employed to produce elements with the same functionality as an array of Fresnel lenses. These elements can be fabricated of low loss plastic by injection molding with single elements as small as a few infrared wavelengths. The use of current microlens and/or diffractive optics techniques to design and fabricate some, possibly all, of the lens elements will produce more capable systems than those that can be produced with current Fresnel lens technology.

The pre-focusing lens may be curved, flat, or nearly flat and possibly segmented. In general the field of view is limited by Fresnel reflection from the surfaces of the pre-focusing element. This limitation is mitigated by the fact that according to the present invention it is possible to use the entire entrance aperture to collect radiation from one resolution element, as opposed to the prior art in which only a small part of the entrance aperture is used to collect radiation from one angular resolution element. Further, in the present configuration the lens array is enclosed within the unit, i.e., protected, and hence can be made thinner than in the prior art without being subject to accidental damage or casual vandalism. In some applications the optimum design is a hybrid system which employs a traditional array of Fresnel lenses and/or mirrors to cover some angular ranges and the design disclosed herein for the remaining angular ranges.

In general by employing a pre-focusing lens it is possible to achieve the same performance with a much smaller entrance aperture than without a pre-focusing lens. This is of importance, for example, in applications where accidental damage or casual vandalism of the entrance aperture lens/cover is a problem. Depending on the required field of view the pre-focusing lens may be flat or bowed outwards (or inwards) One aesthetically appealing configuration is a rocker switch (e.g. Leviton's Decora rocker switch) with a small infrared entrance aperture in the center, both vertically and horizontally, of the rocker. Depending on the precise shape of the entrance window, acceptable performance can be achieved with an aperture as small as 4–8 mm horizontally and 10 mm in height. This would convert the traditional rocker switch to an "automatic switch" i.e. an ordinary switch with an occupancy sensor feature. This aesthetically appealing configuration can also be achieved without a pre-focusing lens. However, a pre-focusing lens can be employed to enlarge the field of view and/or decrease the required aperture size for a given range. This technique can be applied to other wiring devices, e.g., toggle switches, dimmers, timers, outlets, etc. These new designs maintain the traditional appearance of the device while adding the occupancy sensor feature in an inconspicuous way. As previously noted in each of these applications a pre-focusing lens may or may not be employed depending on the specified size of the entrance aperture and the required field of view and range.

In general, for any occupancy sensor or motion detector, the field of view can be increased by employing mirrors adjacent to the entrance aperture to reflect wide angle rays towards the center of the system. These mirrors may be positioned before or after the pre-focusing lens or between the lens array and the detector. Further in some applications the optimum system is a hybrid system in which the mirrors direct and/or focus infrared radiation from some angular sectors directly onto a detector, through one lens array to a detector or through both lens arrays to a detector. Infrared radiation from other angular sectors may be processed differently, i.e., by only one or both of the lens arrays.

The optical system disclosed herein can be designed to operate in a number of modes. In the most straightforward design each element of the lens array performs roughly the same function as an element of the Fresnel lens array in the prior art. Specifically the field of view is divided into a number of angular segments. The pre-focusing lens partially focuses infrared radiation within a small range of angles onto one element of the lens array. As the infrared source moves through this angular range the partially focused beam moves across this element of the lens array and the final focal spot moves from some distance off of one side of the sensitive area of a detector to some distance off of the other side of the sensitive area of the detector. If this is repeated for a number of contiguous angular sectors within the field of view of the system the amount of infrared radiation falling on the sensitive area of the detector varies abruptly as the focal spot moves onto or off of the sensitive area of a detector.

In one particularly interesting implementation, the use of a pre-focusing lens leads to qualitative different performance of a motion detector/occupancy sensor than in the prior art. In this implementation the width of the pre-focused beam on the front surface of the lens array is made equal to the width of one element of the lens array. In order to understand the performance of this system, suppose that the infrared source is in a position such that the pre-focused beam just fills one element of the lens array. As the infrared source moves in either direction, the total power illuminating that element of the lens array is reduced and continues to decrease until the beam moves completely off of one side or the other of the element of the lens array. The system can be designed so that, for the entire small range of angles for which the element of the lens array is partially illuminated, this radiation is focused onto the active area of a detector. As the source moves over this small range of angles, the infrared power incident on the detector varies, which produces a corresponding electrical output that is processed to determine the state of motion of the infrared source. This configuration produces a detectable signal at useful source ranges because: 1) of the greater collecting power of the pre-focusing lens, as opposed to the collecting power of a single element of the Fresnel lens array as in the prior art; and 2) the size of each element of the lens array can be greatly reduced, since it is not employed as a collecting element.

If the lens array in the above system is designed so that every other segment of the array is focused on a detector for some small range of angles and these angular ranges are made contiguous, the system behaves in a qualitatively different way than prior art motion detectors/occupancy sensors. Specifically, this system is capable of detecting motion for any angular orientation of the source not only when the source crosses the boundary between an angular sector which illuminates a detector and one which does not. The elements of the lens array which interlace those described above can be simply left unused or employed to focus other, possibly contiguous, angular sectors onto a second detector.

It is not unusual for prior art occupancy sensors and motion detectors to employ a small number of Fresnel lens arrays side by side on the front surface of the unit. These arrays are designed to have different fields of view and/or different ranges. According to the present invention the size of one particular lens element in the array may be made small enough such that many rows of lenses can be employed in a practical system. With such a truly two-dimensional array of lenses, qualitatively different performance can be achieved than in the prior art. Specifically, prior art systems can only detect motion in one angular direction. With a two-dimensional array of lenses motion can be detected in three-directions. For example, with a wallbox or wall mounted system a vertically mounted two-dimensional array can clearly detect vertical as well as angular horizontal motion. Such a system can also detect radial motion in the horizontal plane because an infrared source moving in this direction is also changing its angle with respect to a vertical through the lens array. A properly designed pre-focusing lens and two-dimensional array can also give information about the angular size and range of a moving infrared source. This would greatly increase the noise rejection capabilities of the system.

All of the preceding is equally applicable to, for example, wall and ceiling units, indoor and outdoor units in lighting, heating, ventilation and/or security applications. Also, it is equally applicable to passive and active infrared, optical and microwave systems. Further, the implementations disclosed herein may be used in single technology systems or in combination with motion detectors/occupancy sensors based on other technologies, e.g., active ultrasonic or microwave systems.

BRIEF DESCRIPTION OF THE DRAWINGS

The above and other objects, features, and advantages of the present invention will become more apparent in light of the following detailed description of the preferred embodiments thereof taken in conjunction with the attached drawings in which.

DETAILED DESCRIPTION OF THE PREFERRED EMBODIMENTS

Figure 1:
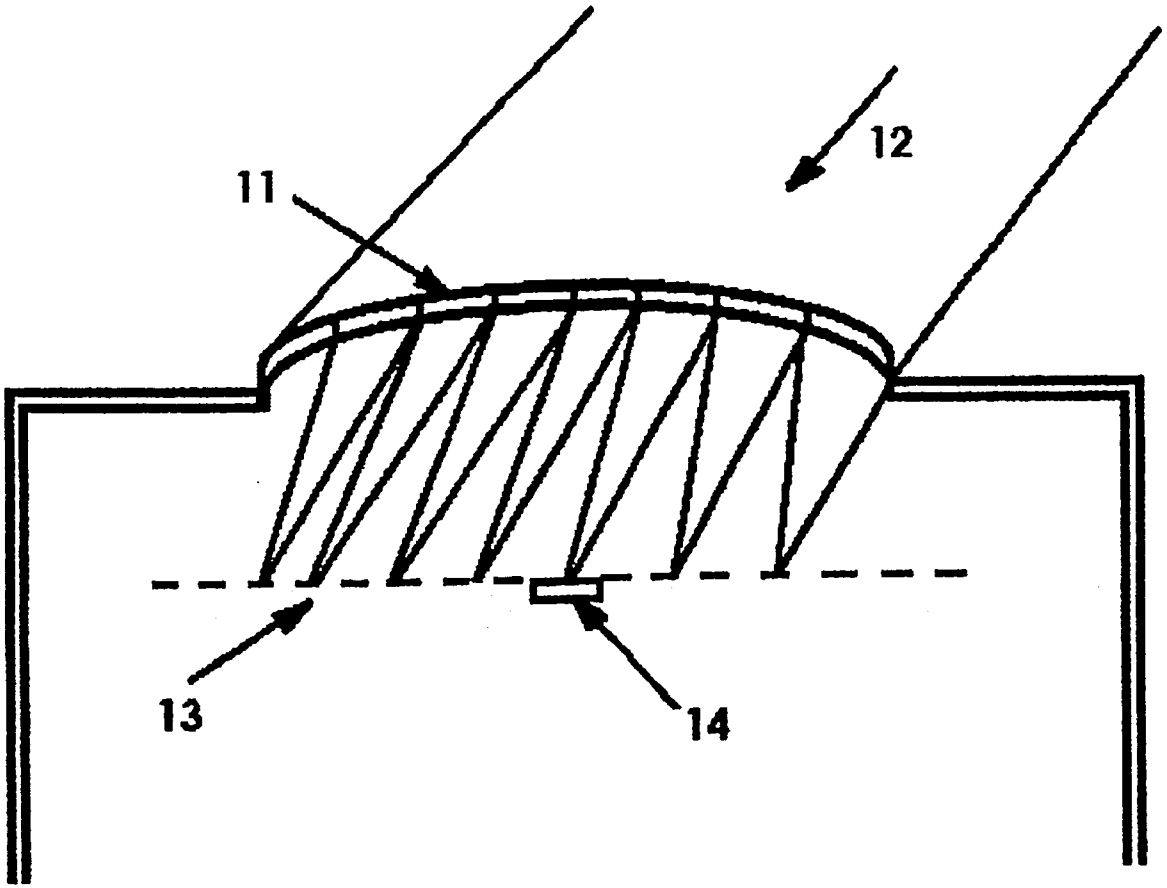
FIGURE 1 (PRIOR ART)
FIG. 1 is a schematic diagram of the infrared input section of motion detectors and occupancy sensors according to the prior art.

Turning now to the drawings, in which like reference numerals identify similar or identical elements throughout the several views, FIG. 1 shows the input section of a typical passive infrared motion detector/occupancy according to prior art. A Fresnel lens array 11 spans the entrance aperture. Each element of the Fresnel lens array 11 intercepts a small fraction of the input infrared radiation 12 incident from some particular direction and focuses it to a spot 13 in the focal plane of that element. This leads to a number of focal spots equal to the number of elements of the Fresnel lens array 11. For simplicity we have shown all of the focal spots in one plane. If the source of the infrared radiation is moving, the angle of incidence of the incident radiation changes and the system of focal spots moves across the active area of a detector 14. Thus, as the source moves, the electrical output of the detector changes abruptly as a spot moves onto or off of the active area of the detector. Notice that in this configuration only a small fraction of the infrared radiation falling onto the entrance aperture is ever focused onto the active area of a detector.

Figure 2:
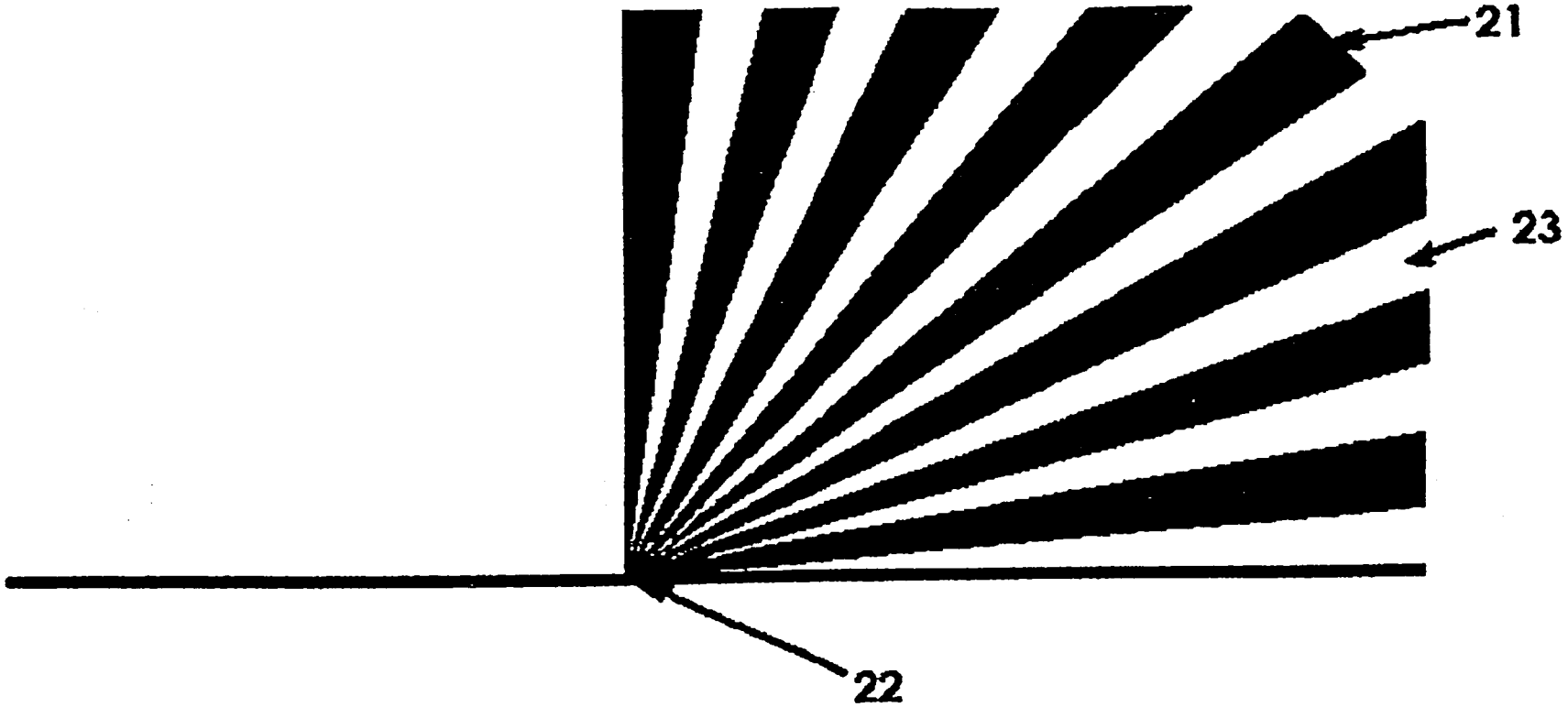
FIGURE 2 (PRIOR ART)
FIG. 2 illustrates the angular sectors which define the angular resolution of motion detectors and occupancy sensors according to the prior art.

FIG. 2 illustrates the angular ranges 21 in which one of the focal spots of the Fresnel lens array of the motion detector/occupancy sensor 22 is on the active area of a detector. These ranges are interlaced by angular ranges 23 in which none of the focal spots is on the active area of any detector. Prior art detection schemes only detect an infrared source when it crosses an edge from one of the angular sectors of type 21 to one of the angular sectors of type 23 or conversely.

Figure 3:
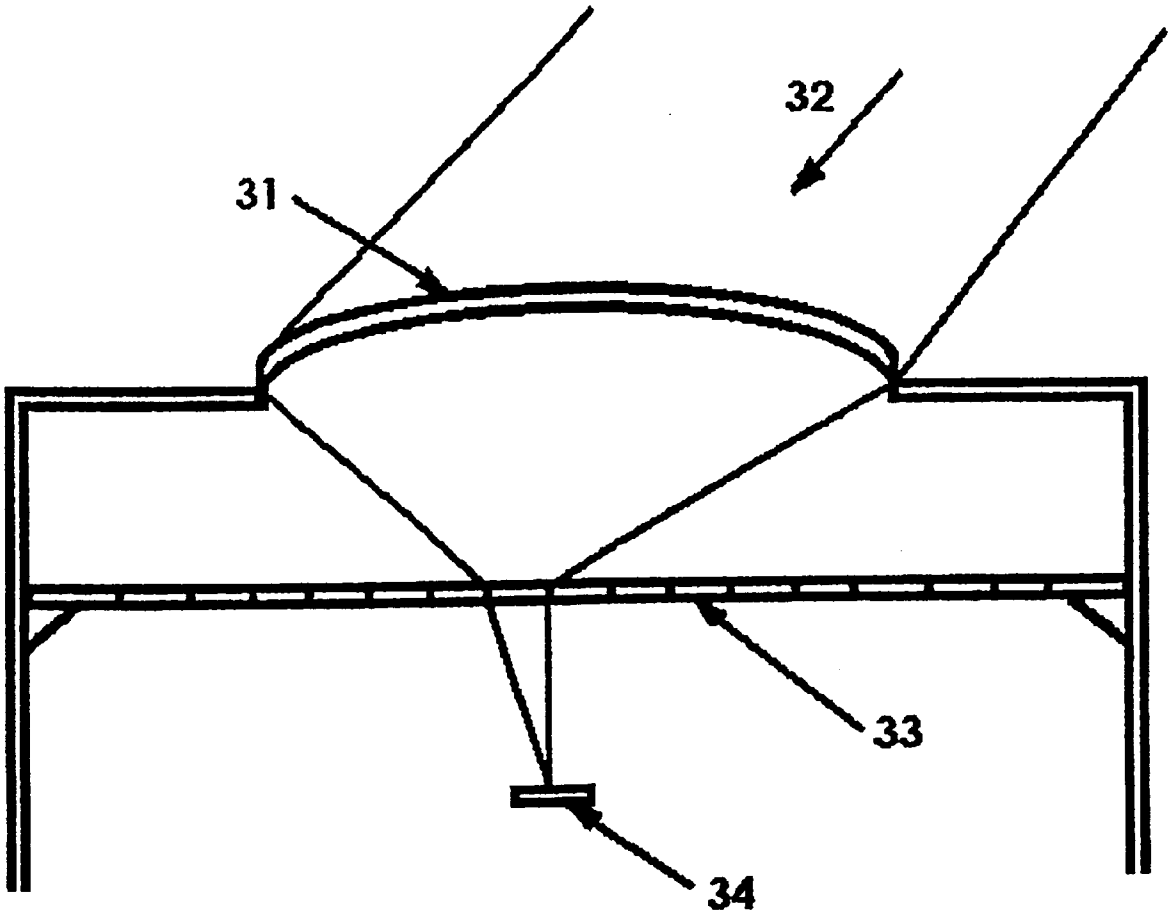
FIG. 3 is a diagram illustrating an exemplary embodiment of the infrared input section of motion detectors and occupancy sensors employing a pre-focusing lens in accordance with the present invention.

FIG. 3 is a diagram of the infrared input section of a motion detector/occupancy sensor which employs a pre-focusing lens 31 as disclosed herein. The pre-focusing lens may or may not be a Fresnel lens and may or may not be segmented. All of the input infrared radiation 32 incident on the entrance aperture is partially focused onto a lens array 33. This array may be curved and may be an array of Fresnel lenses, microlenses or an element which is designed on the basis of the principles of diffractive optics. In FIG. 3 the width of the partially focused beam at the front surface of the lens array is shown equal to the width of a single element of the lens array. This is only one possible implementation. In general the width of the partially focused beam at the front surface of the lens array may be larger, smaller or equal to the width of one element of the lens array depending on the performance desired. When the width of the pre-focused beam is equal to the width of one element of the lens array, and alternate elements are focused on the active area of a detector for a small range of source angles, the angular resolution of the system can be reduced to zero by making the angular ranges contiguous.

Another implementation of this system employs a pre-focused beam which is small compared to the size of one element of the lens array. As the infrared emitter moves so that the angle of incidence of the infrared radiation varies, the pre-focused beam moves across the lens array 33. This array is designed so that when the focal spot of the pre-focusing lens 31 first moves onto an element of the array 33, that element of the array 33 focuses the infrared radiation off of one edge of the active area of a detector 34. As the pre-focused beam moves across the element of the lens array the focal spot of the array element moves across and off of the active area of the detector 34. When the pre-focused beam moves onto the next element of the lens array 33 the process repeats.

As noted previously one advantage of the input configuration disclosed herein is that all of the infrared radiation 32 incident on the entrance aperture is focused onto a detector 34. This greatly increases the amount of infrared power available to the electro-optic system. Alternatively, the size of the entrance aperture can be decreased without decreasing the amount of power available to the electro-optic system. A second advantage of this configuration is that the elements of the lens array 33 can be made smaller than in the prior art without decreasing the amount of power available to the electro-optic system. Consequently a larger number of elements can be employed with an entrance aperture of fixed size. This improves the angular resolution of the system. In some applications a segmented pre-focusing lens is desirable. A properly designed two-dimensional lens array can be used to detect vertical and horizontal radial motion, as well as angular motion, and can additionally provide information about the angular size and range of an infrared source.

Figure 4:
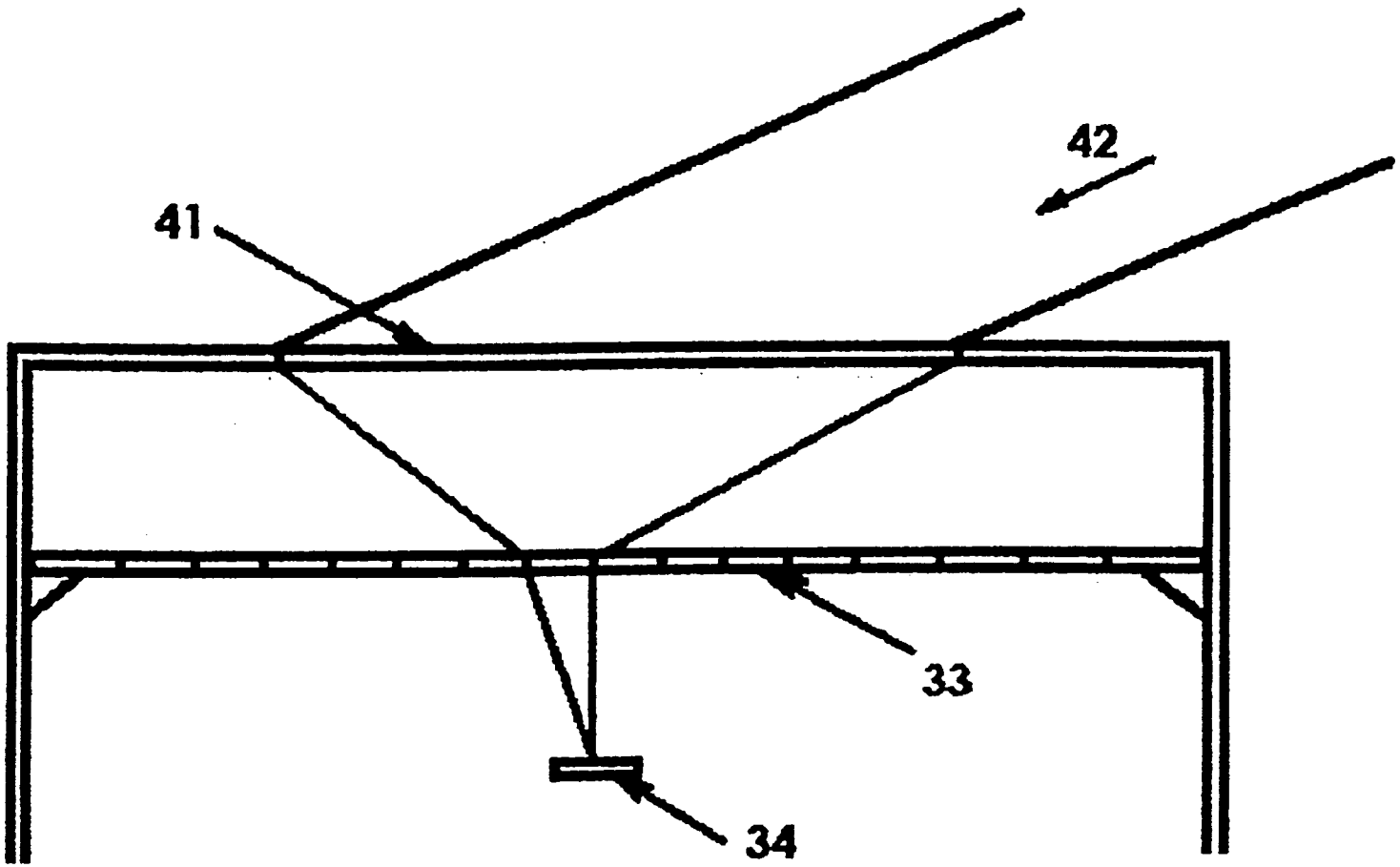
FIG. 4 is a diagram illustrating an exemplary embodiment of the infrared input section of motion detectors and occupancy sensors employing a flat pre-focusing lens in accordance with the present invention.

FIG. 4 illustrates the use of a flat pre-focusing lens 41. Ordinarily the use of a flat lens or cover on a motion detector/occupancy sensor seriously restricts the angular field of view of the system because of large Fresnel reflections at the surfaces of the lens or cover at wide angles. One of the advantages of the present invention is that almost all of the infrared radiation 42 incident on the entrance aperture is partially focused onto a lens array 33 and then onto the detector 34. This means that larger Fresnel reflection can be tolerated or equivalently a wider field of view can be achieved.

Figure 5:
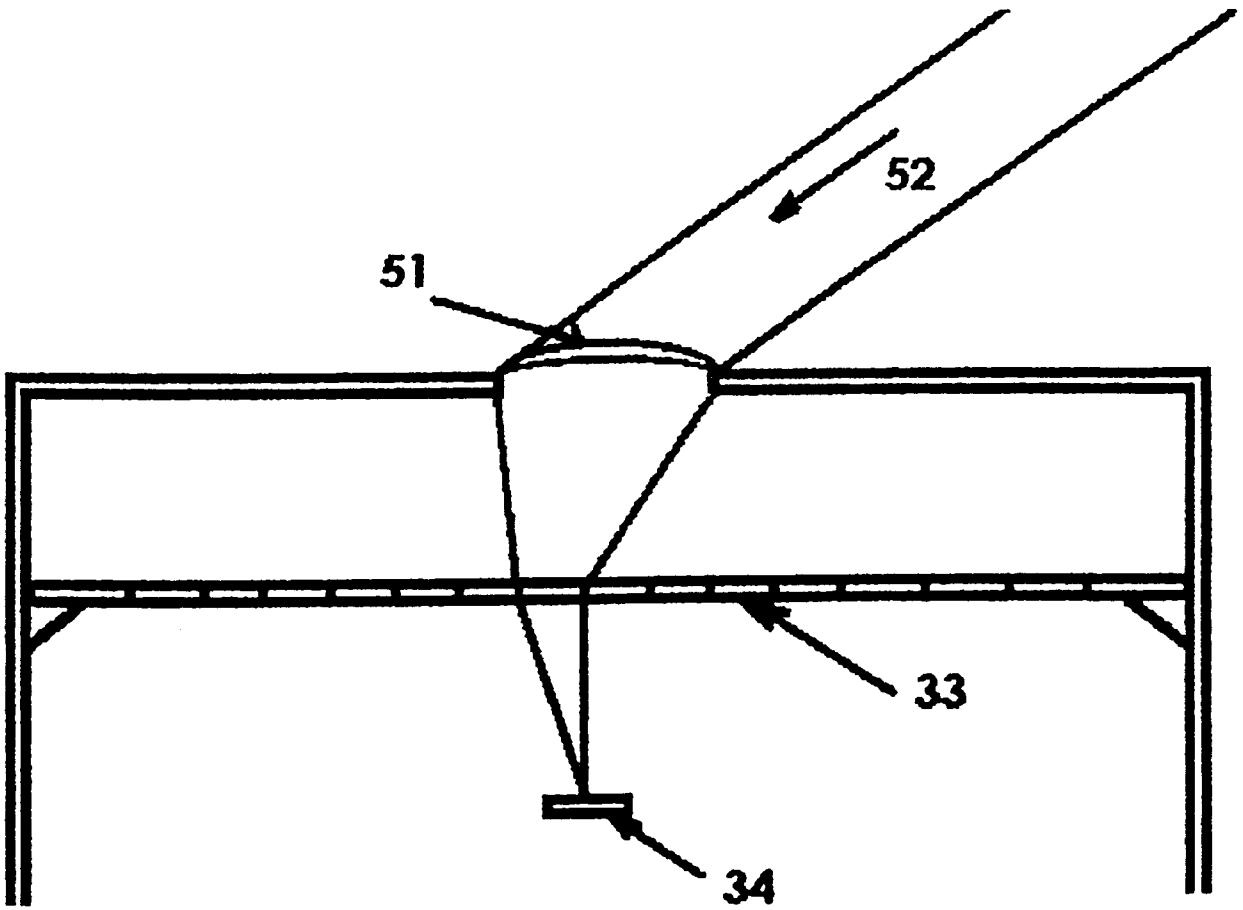
FIG. 5 is a diagram illustrating an exemplary embodiment of the infrared input section of small aperture motion detectors and occupancy sensors employing a pre-focusing lens in accordance with the present invention.

FIG. 5 is a diagram which illustrates the fact that by employing a pre-focusing lens 51, the size of the entrance aperture can be reduced without degrading the sensitivity, angular resolution or range of the system. As in previous implementations both the pre-focusing lens and the lens array may be curved.

Figure 6:
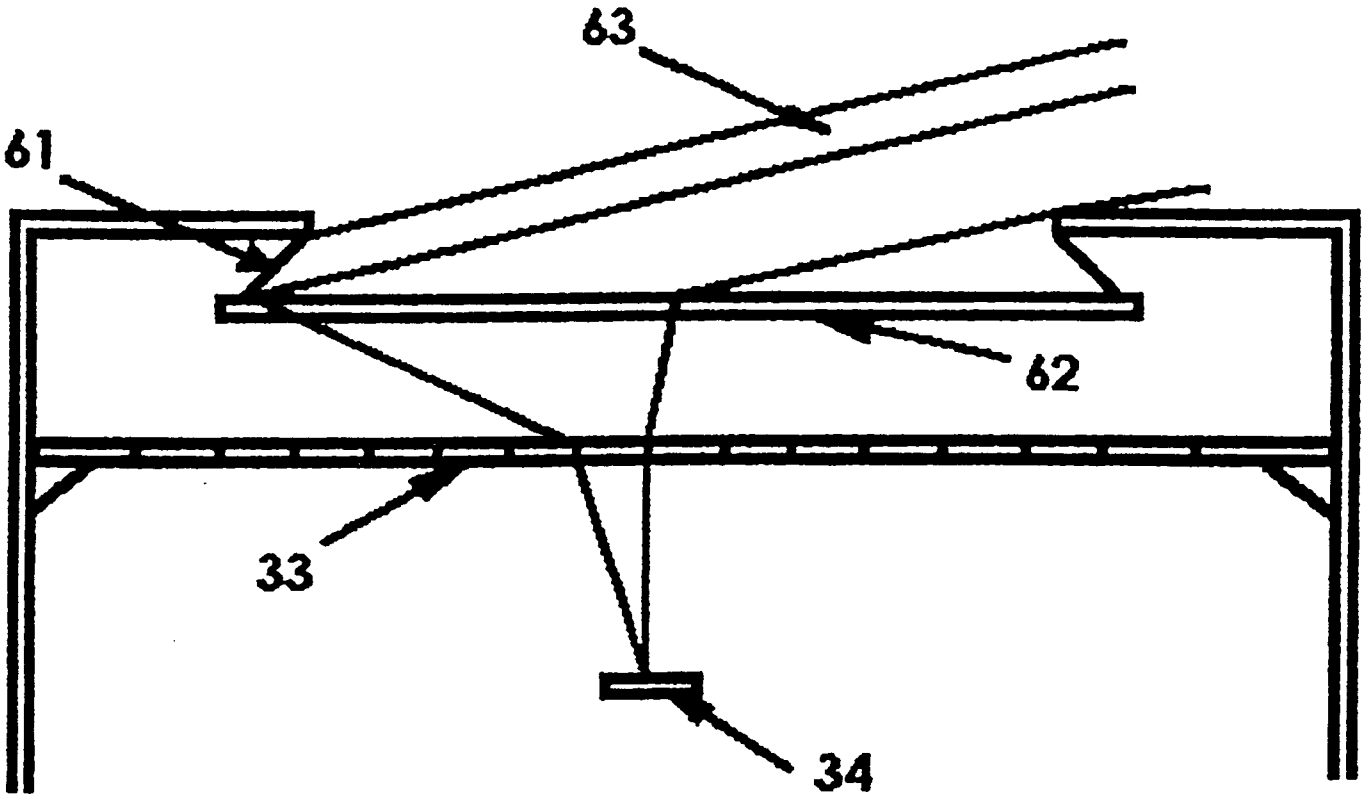
FIG. 6 is a diagram illustrating of an exemplary embodiment of the infrared input section of motion detectors and occupancy sensors employing a pre-focusing lens and wide angle mirrors in accordance with the present invention.

FIG. 6 is a diagram illustrating an implementation which can be used to achieve wide angle coverage, approaching 180 degrees. One or more mirrors 61 are located adjacent to the pre-focusing lens 62. The mirrors 61 intercept wide angle infrared radiation 63 and re-direct it onto the pre-focusing lens 62. The pre-focusing lens 62 serves the same functions as those previously disclosed with reference to the lens array 33 and detector 34. This system can also be implemented with a cover plate over the entrance aperture. It is also possible to employ a recessed pre-focusing lens 62, as illustrated in FIG. 6, without the mirrors 61. This system has a narrower useful field of view. Curved mirrors can be employed to supply additional focusing, positioning or re-direction of the incident infrared energy. Mirrors can also be employed between the lens array and the detector to redirect infrared energy onto the detector.

Figure 7:
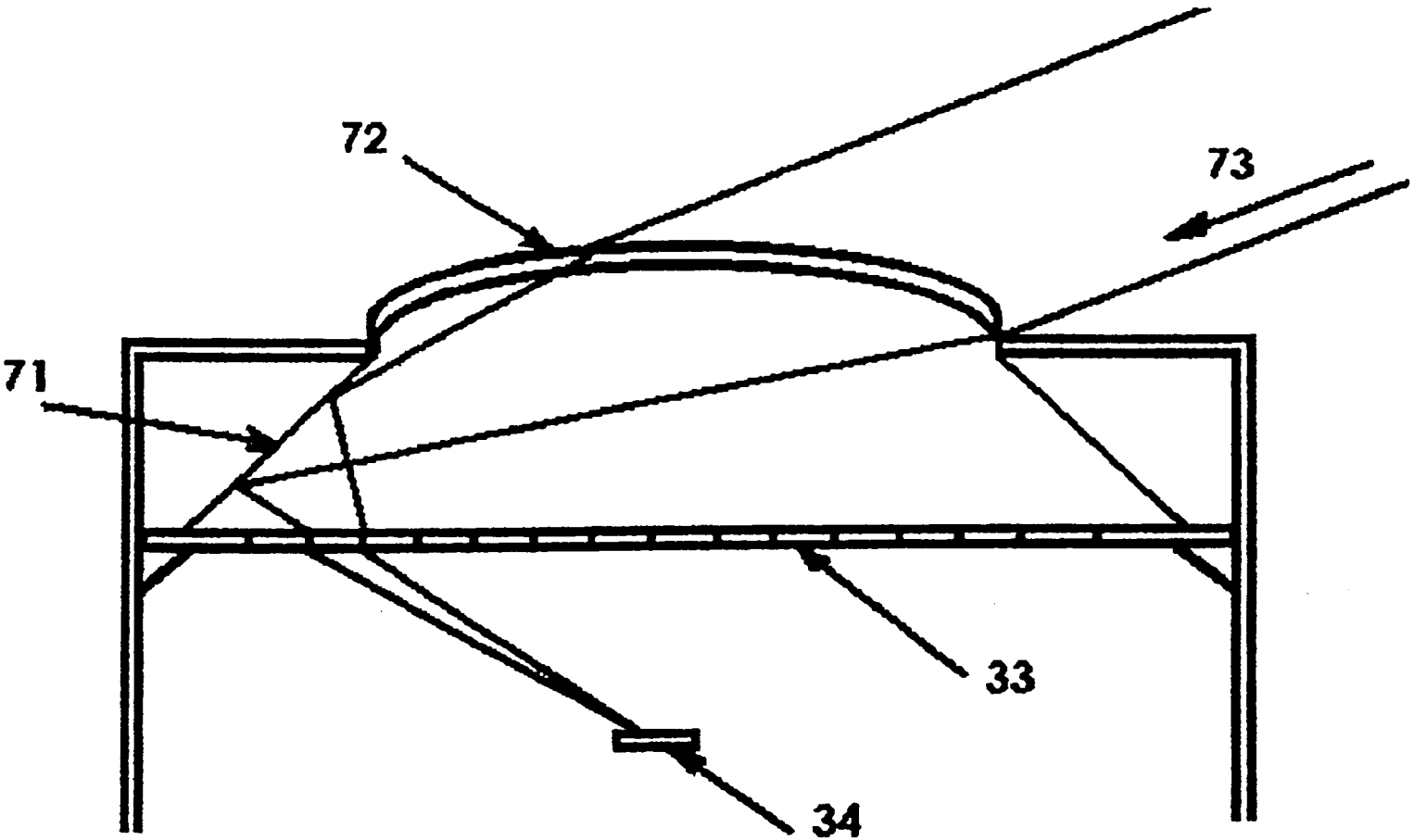
FIG. 7 is a diagram illustrating another exemplary embodiment of the infrared input section of motion detectors and occupancy sensors employing a pre-focusing lens and wide angle mirrors in accordance with the present invention.

FIG. 7 is a diagram illustrating another implementation of a wide angle system, i.e. a field of view approaching 180 degrees. In this implementation the mirrors 71 and pre-focusing lens 72 are interchanged as compared with FIG. 6. Also in this configuration the pre-focusing lens 72 serves as a cover plate. As previously noted, curved mirrors can be employed to supply additional focusing, positioning or re-direction of the incident infrared energy. As in previous implementations mirrors can also be employed between the lens array and the detector to redirect infrared energy onto the detector.

Figure 8:
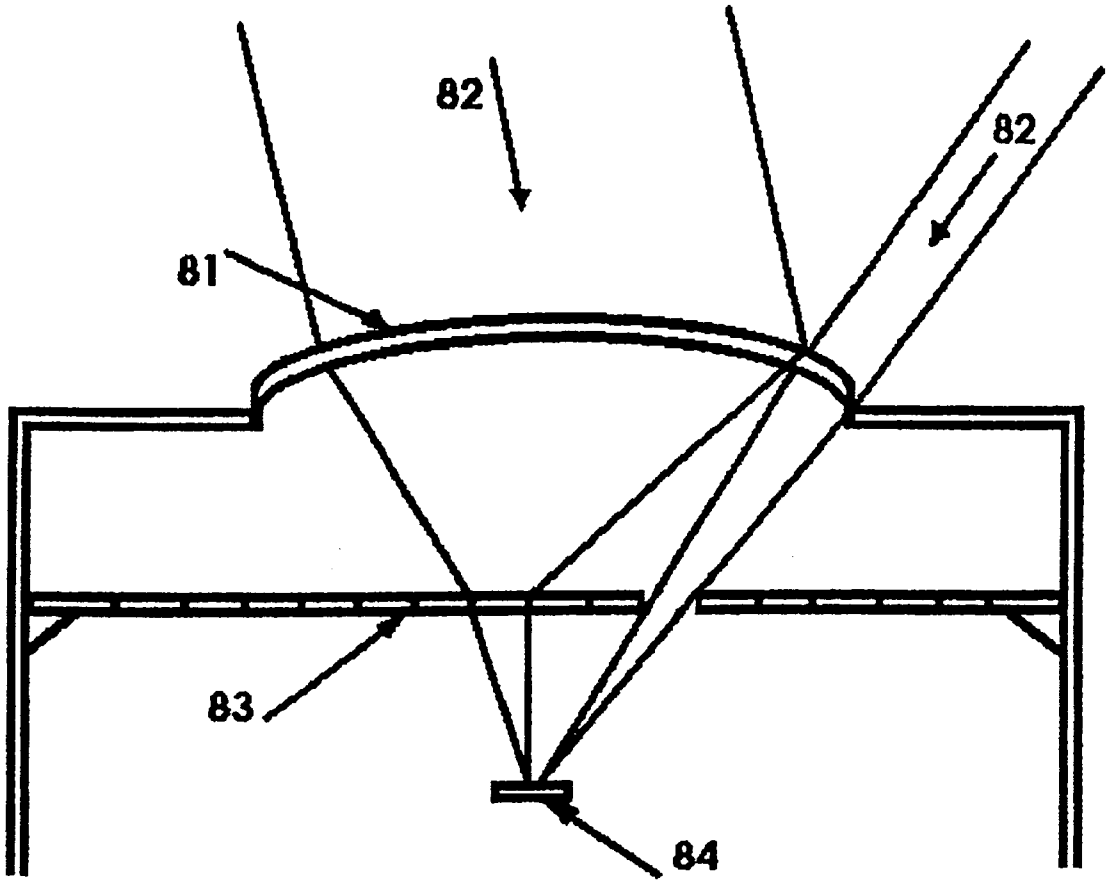
FIG. 8 is a diagram illustrating an exemplary embodiment of a hybrid infrared input section of motion detectors and occupancy sensors employing a pre-focusing lens in accordance with the present invention for some angular sectors but not for other angular sectors.

FIG. 8 is a diagram of one possible variation of the configuration shown in FIG. 3. The difference is that for some angular sectors infrared radiation 82 incident on the first lens array 81 is focused directly onto the detector 84. One or more segments of the second lens array 83 are omitted. Infrared radiation 82 incident on the remaining sectors of the pre-focusing lens array 81 is partially focused onto the second lens array 83 and then onto the detector 84 in the manner previously described.

Figure 9:
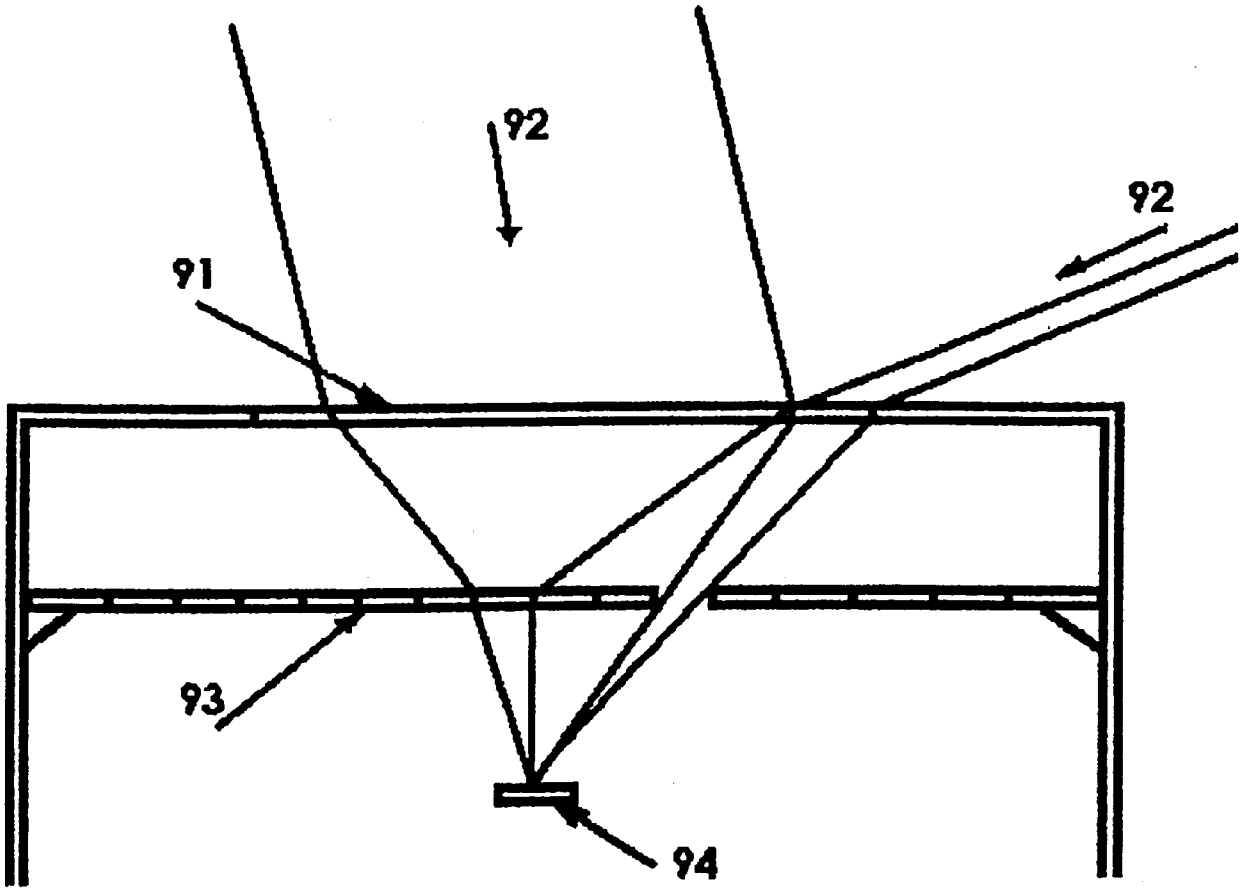
FIG. 9 is a diagram illustrating an exemplary embodiment of a hybrid infrared input section of motion detectors and occupancy sensors employing a flat pre-focusing lens in accordance with the present invention for some angular sectors but not for other angular sectors.

FIG. 9 is a diagram of one possible variation of the configuration shown in FIG. 4. The difference is that for some angular sectors infrared radiation 92 incident on the first lens array 91 is focused directly onto the detector 94. One or more segments of the second lens array 93 are omitted. Infrared radiation 92 incident on the remaining sectors of the pre-focusing lens array 91 is partially focused onto the second lens array 93 and then onto the detector 94 in the manner previously described.

Figure 10:
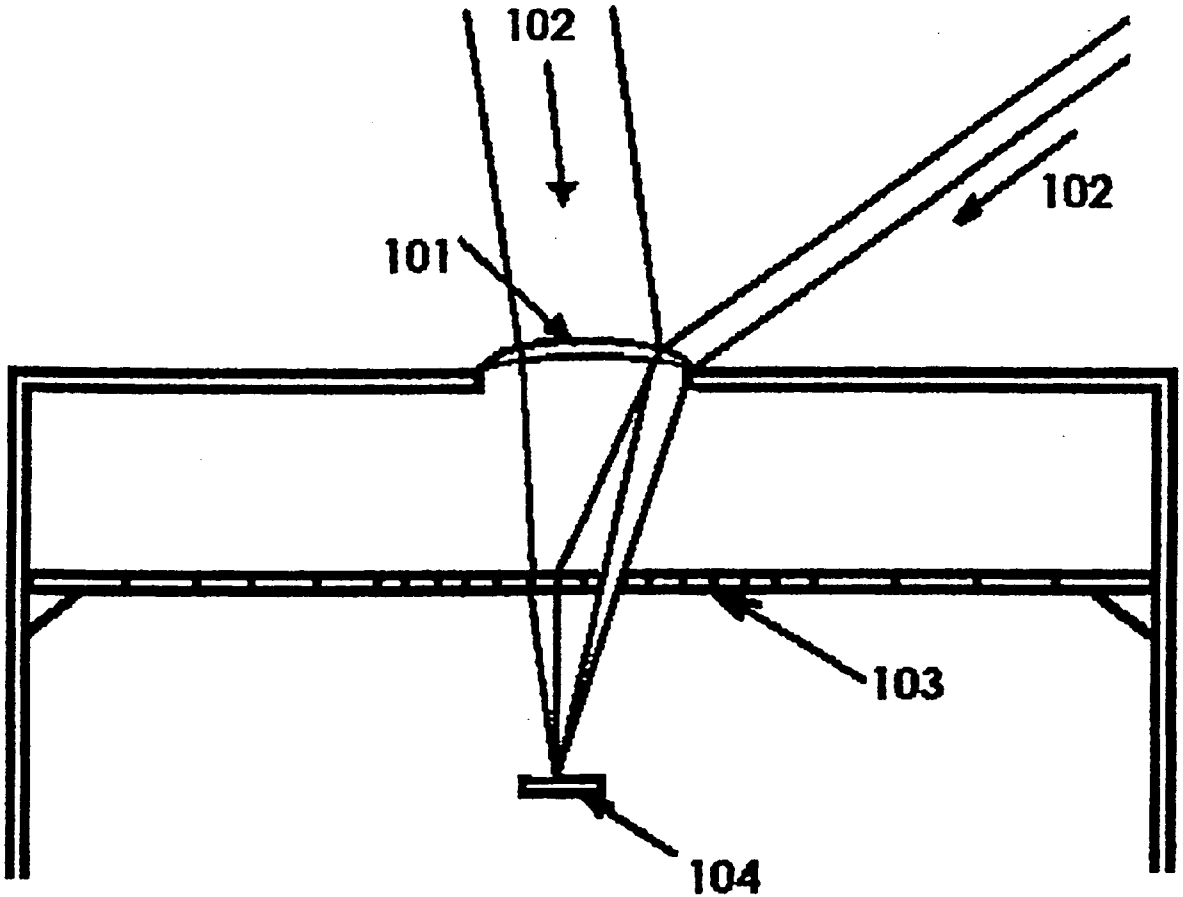
FIG. 10 is a diagram illustrating an exemplary embodiment of a hybrid infrared input section of small aperture motion detectors and occupancy sensors employing a pre-focusing lens in accordance with the present invention for some angular sectors but not for other angular sectors.

FIG. 10 is a diagram of one possible variation of the configuration shown in FIG. 5. The difference is that for some angular sectors infrared radiation 102 incident on the first lens array 101 is focused directly onto the detector 104. One or more segments of the second lens array 103 are omitted. Infrared radiation 102 incident on the remaining sectors of the pre-focusing lens array 101 is partially focused onto the second lens array 103 and then onto the detector 104 in the manner previously described.

Figure 11:
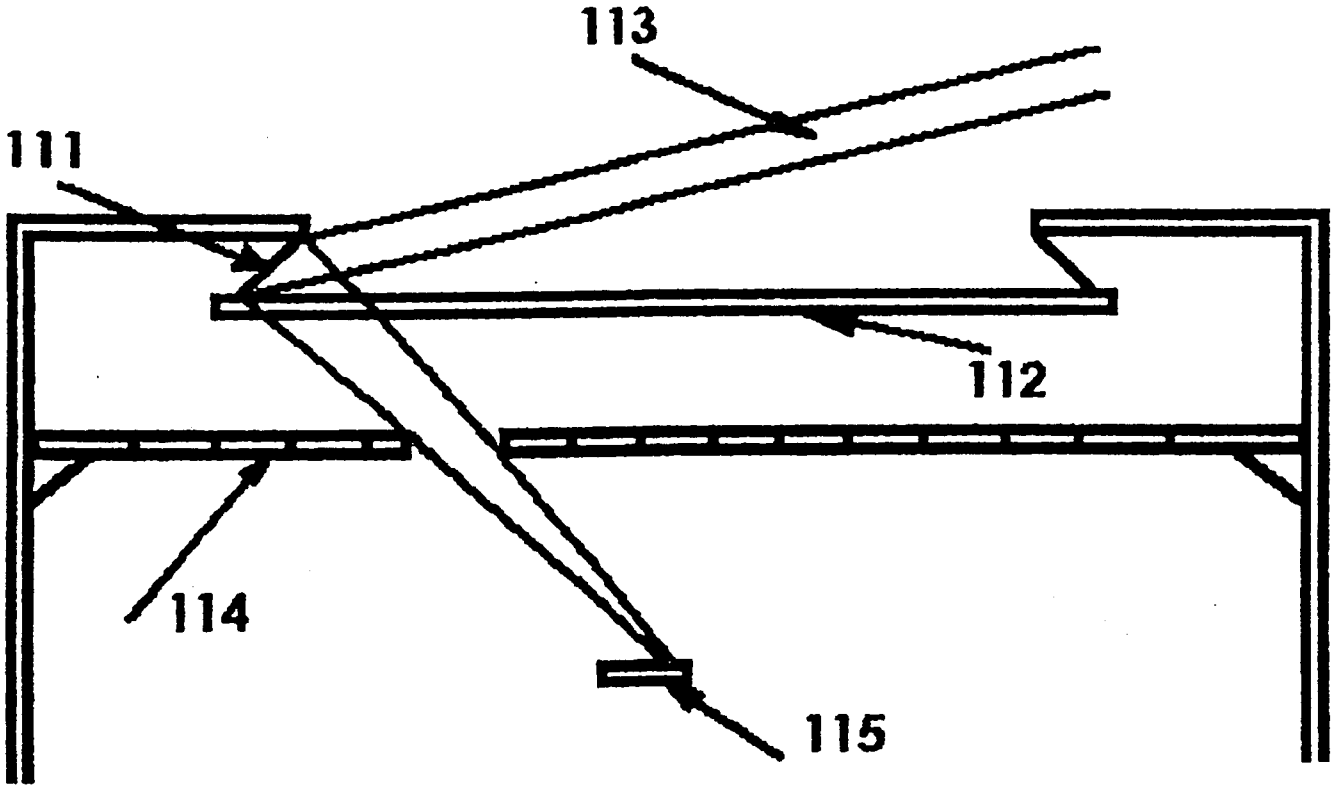
FIG. 11 is a diagram illustrating an exemplary embodiment of a hybrid infrared input section of motion detectors and occupancy sensors employing a pre-focusing lens and wide angle mirrors in accordance with the present invention with some segments of the second lens array omitted.

FIG. 11 is a diagram of one possible variation of the configuration shown in FIG. 6. The difference is that for some angular sectors infrared radiation 113 directed by mirror 111 to the first lens array 112 is focused directly onto the detector 115. One or more segments of the second lens array 114 are omitted. Infrared radiation directed by mirror 111 onto the remaining sectors of the pre-focusing lens array 112 is partially focused onto the second lens array 114 and then onto the detector 115 in the manner previously described.

Figure 12:
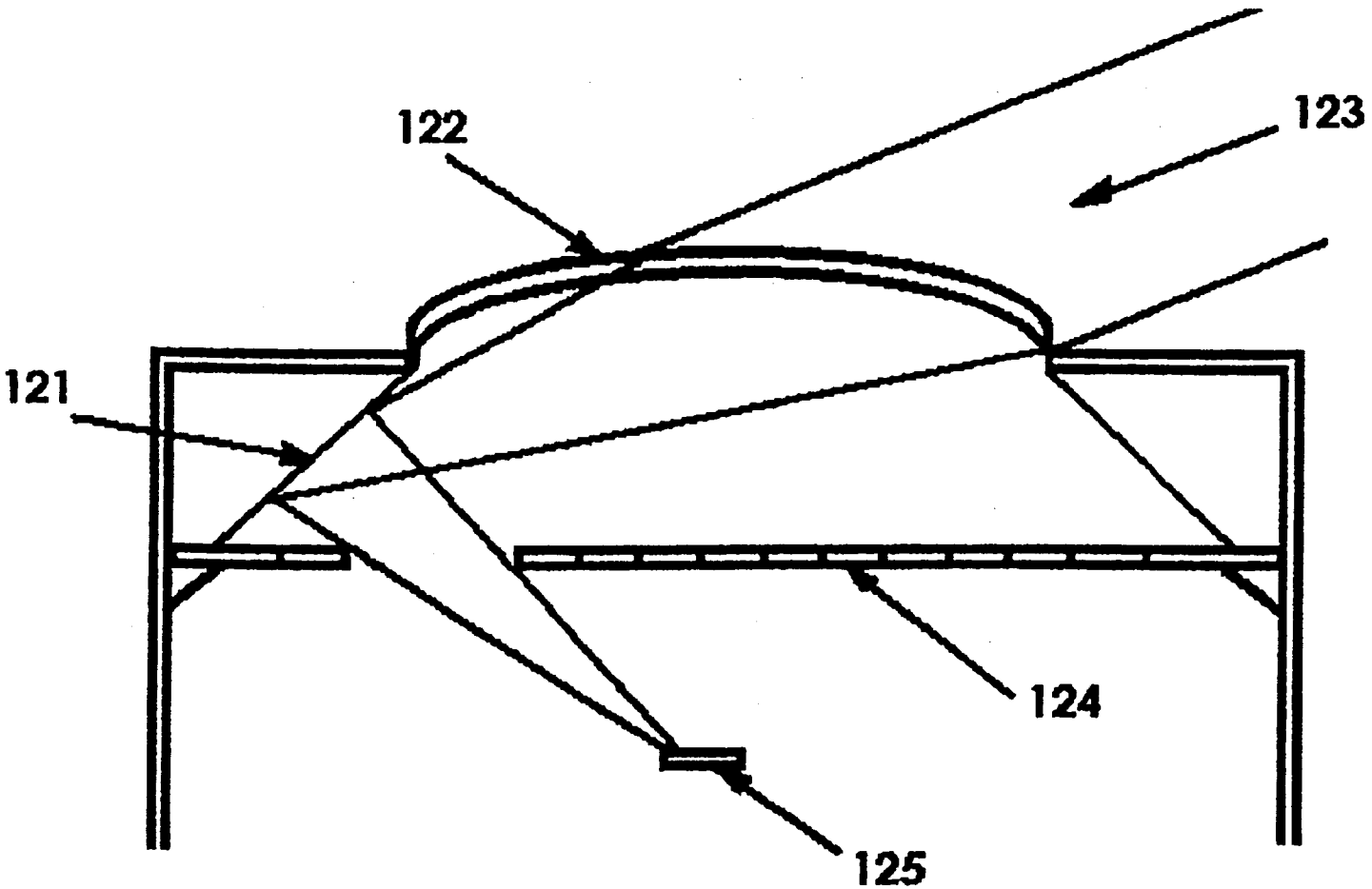
FIG. 12 is a diagram illustrating another exemplary embodiment of the infrared input section of motion detectors and occupancy sensors employing a pre-focusing lens and wide angle mirrors in accordance with the present invention with some segments of the second lens array omitted.

FIG. 12 is a diagram of one possible variation of the configuration shown in FIG. 7. The difference is that for some angular sectors infrared radiation 123 incident on the first lens array 122 is reflected and/or focused by mirror 121 directly onto the detector 125. One or more segments of the second lens array 124 are omitted. Infrared radiation incident on the remaining sectors of the pre-focusing lens array 122 is either reflected by mirror 121 onto second lens array 124 or is partially focused directly onto the second lens array 124 and then onto the detector 125 in the manner previously described.

Figure 13:
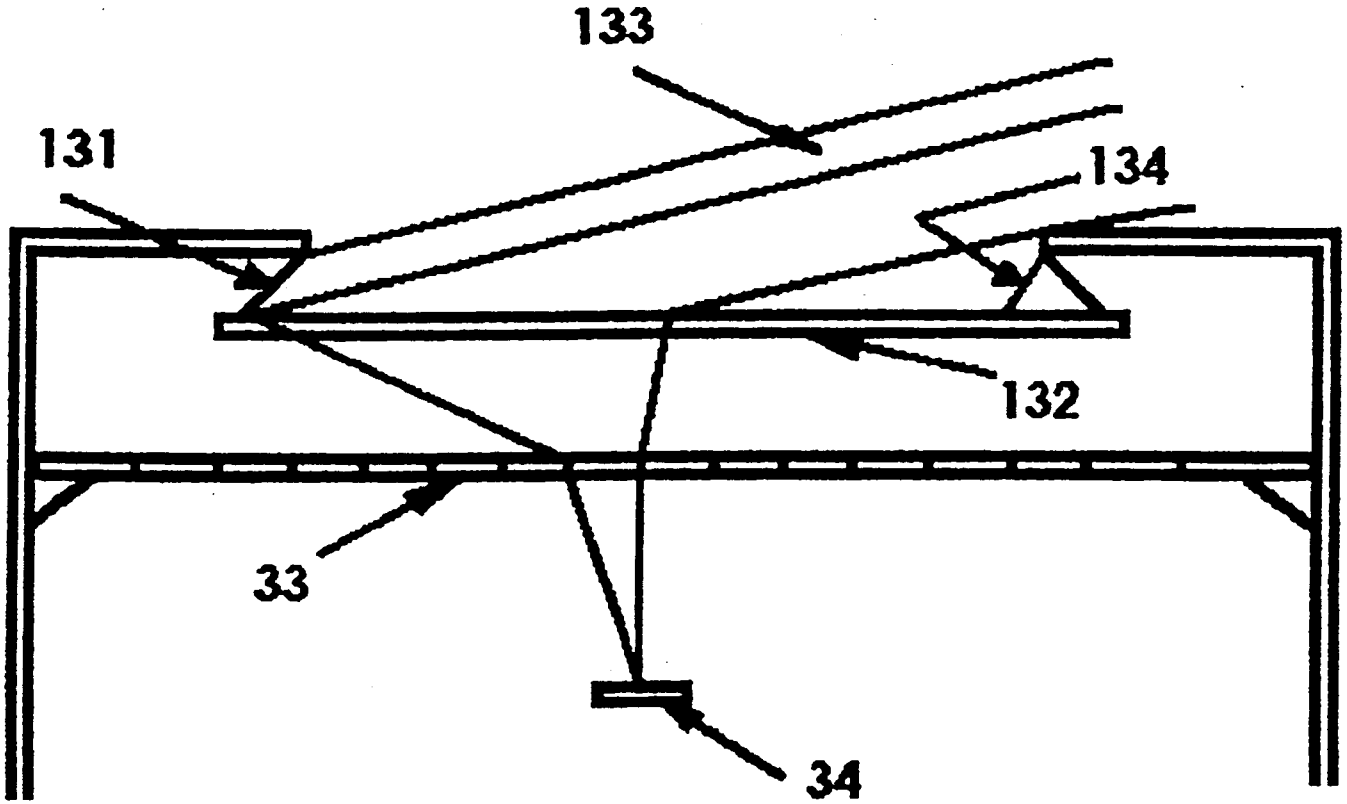
FIG. 13 is a diagram illustrating an exemplary embodiment wherein a cover element (either an additional lens array or a plain cover) is included over at least one of the mirrors of the configurations shown in either FIG. 6 or 11.

FIG. 13 is a diagram of one possible variation of the configurations shown in FIGS. 6 and 11. The difference is that in the configuration shown in FIG. 13 at least one of the mirrors 131 is preceded by an infrared transparent cover element. The cover element 135 can be either a simple, clear cover or an additional lens array.

Figure 14:
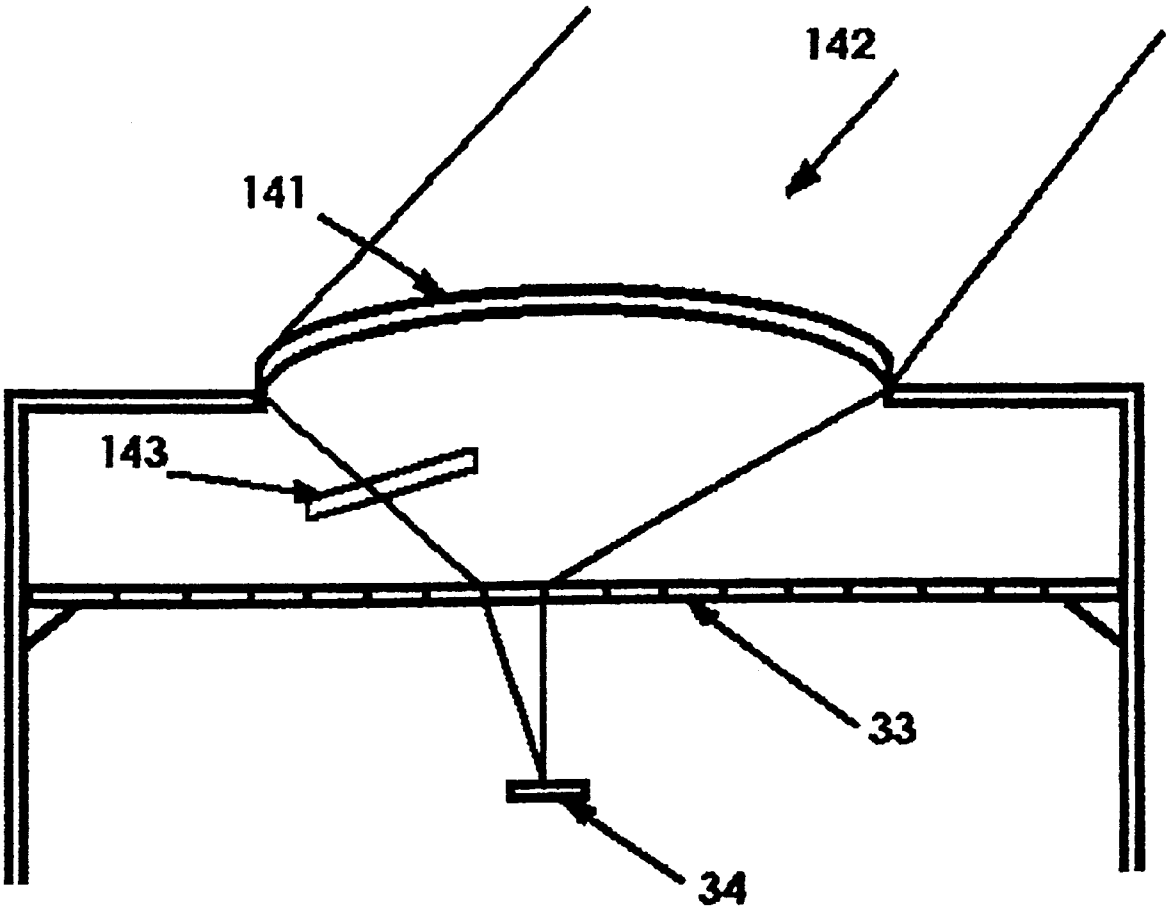
FIG. 14 is a diagram illustrating an exemplary embodiment wherein an additional lens array is included between the two lens arrays indicated in FIG. 3 or 8.

FIG. 14 is a diagram of one possible variation of the configurations shown in FIGS. 3 and 8. The difference is that in the configuration shown in FIG. 14 an additional lens array 143 is included between the two lens arrays 141 and 33. The purpose of lens array 143 is to redirect and focus infrared radiation which has passed the first lens array 141, onto the appropriate segment of the final lens array 33 preceding the detector 34.

Figure 15:
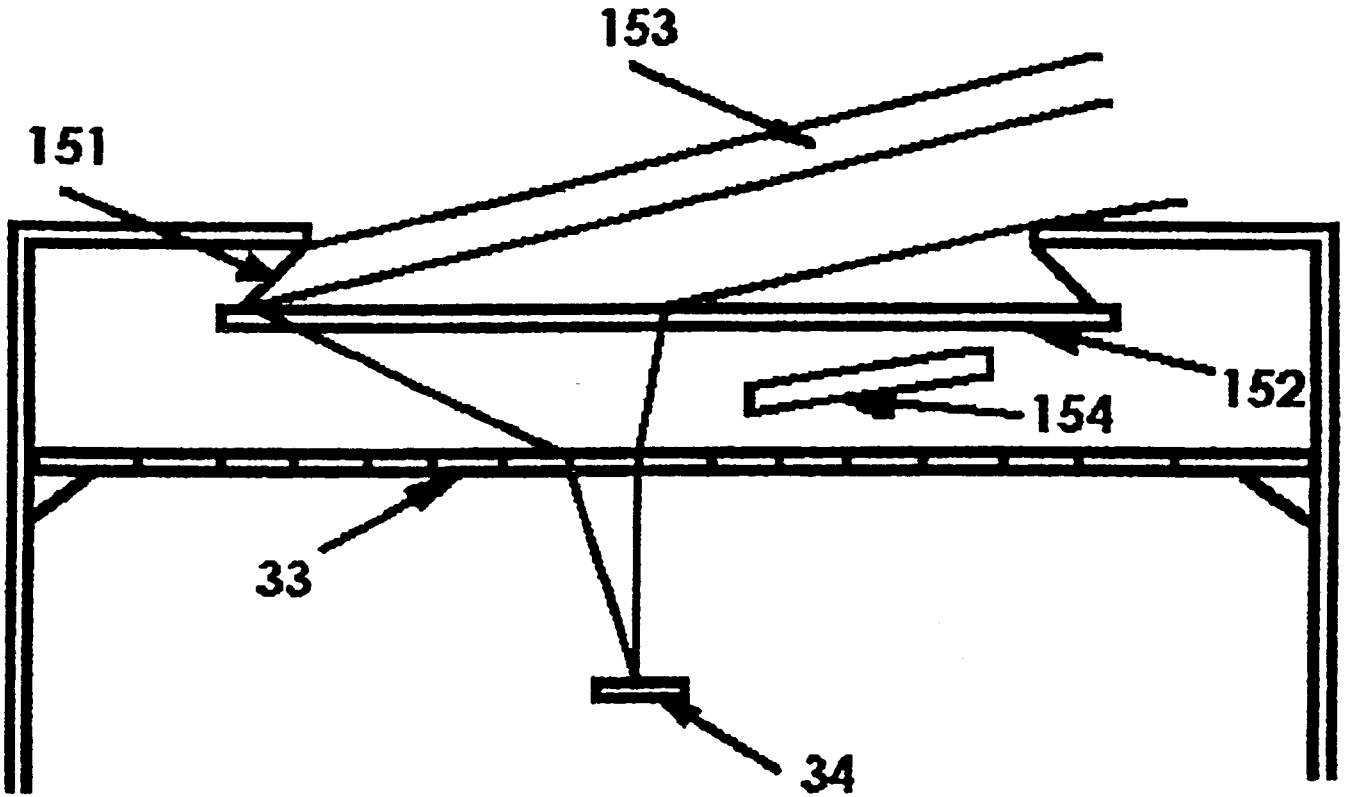
FIG. 15 is a diagram illustrating an exemplary embodiment wherein an additional lens array is included between the two lens arrays indicated in FIG. 6 or 11.

FIG. 15 is a diagram of one possible variation of the configurations shown in FIGS. 6 and 11. The difference is that in the configuration shown in FIG. 15 an additional lens array 154 is included between the two lens arrays 152 and 33. The purpose of lens array 154 is to redirect and focus infrared radiation which has passed the first lens array 152, onto the appropriate segment of the final lens array 33 preceding the detector 34.

Figure 16:
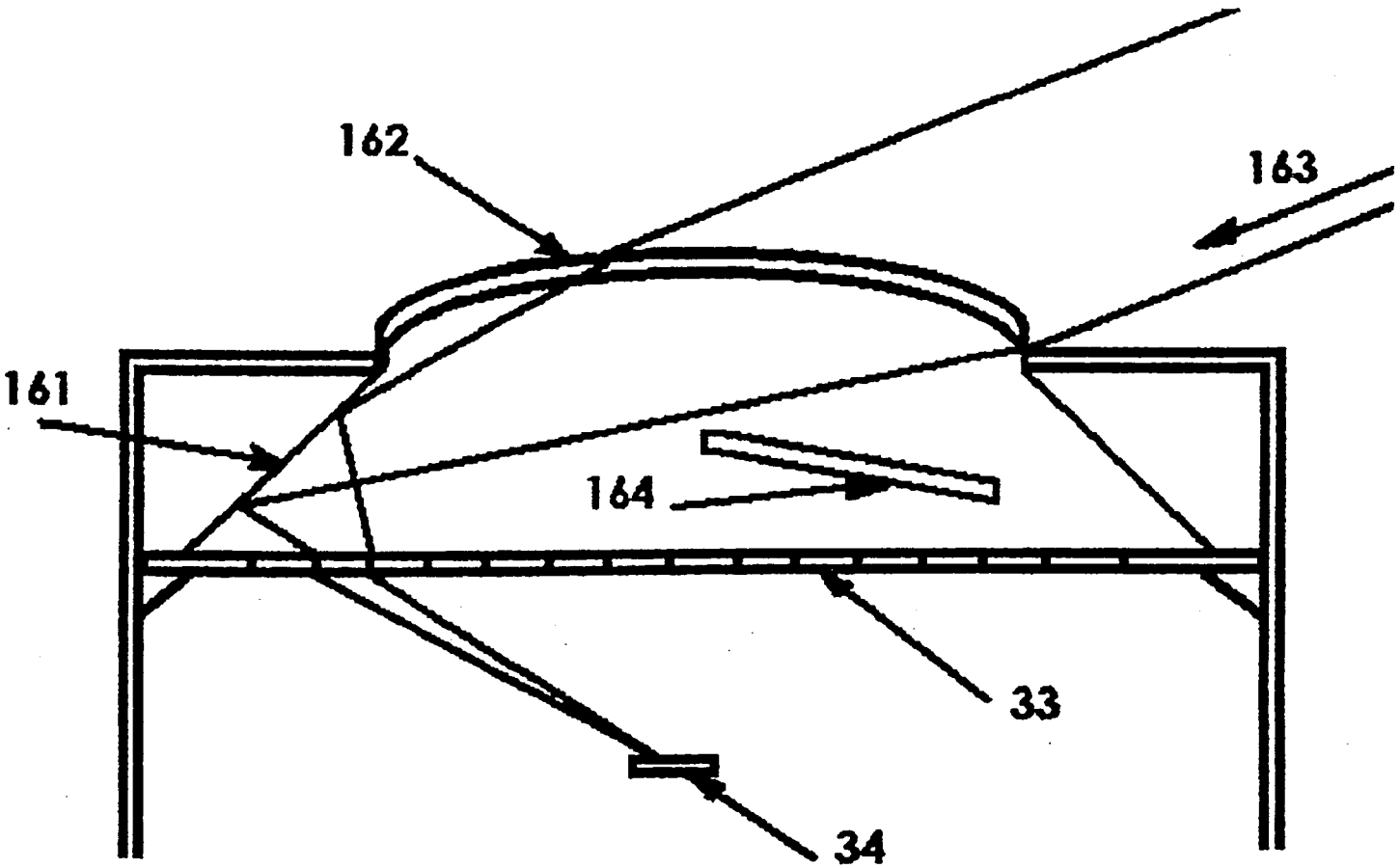
FIG. 16 is a diagram illustrating an exemplary embodiment wherein an additional lens array is included between the two lens arrays indicated in FIG. 7 or 12.

FIG. 16 is a diagram of one possible variation of the configurations shown in FIGS. 7 and 12. The difference is that in the configuration shown in FIG. 16 an additional lens array 164 is included between the two lens arrays 162 and 33. The purpose of lens array 164 is to redirect and focus infrared radiation which has passed the first lens array 162, onto the appropriate segment of the final lens array 33 preceding the detector 34.

Figure 17:
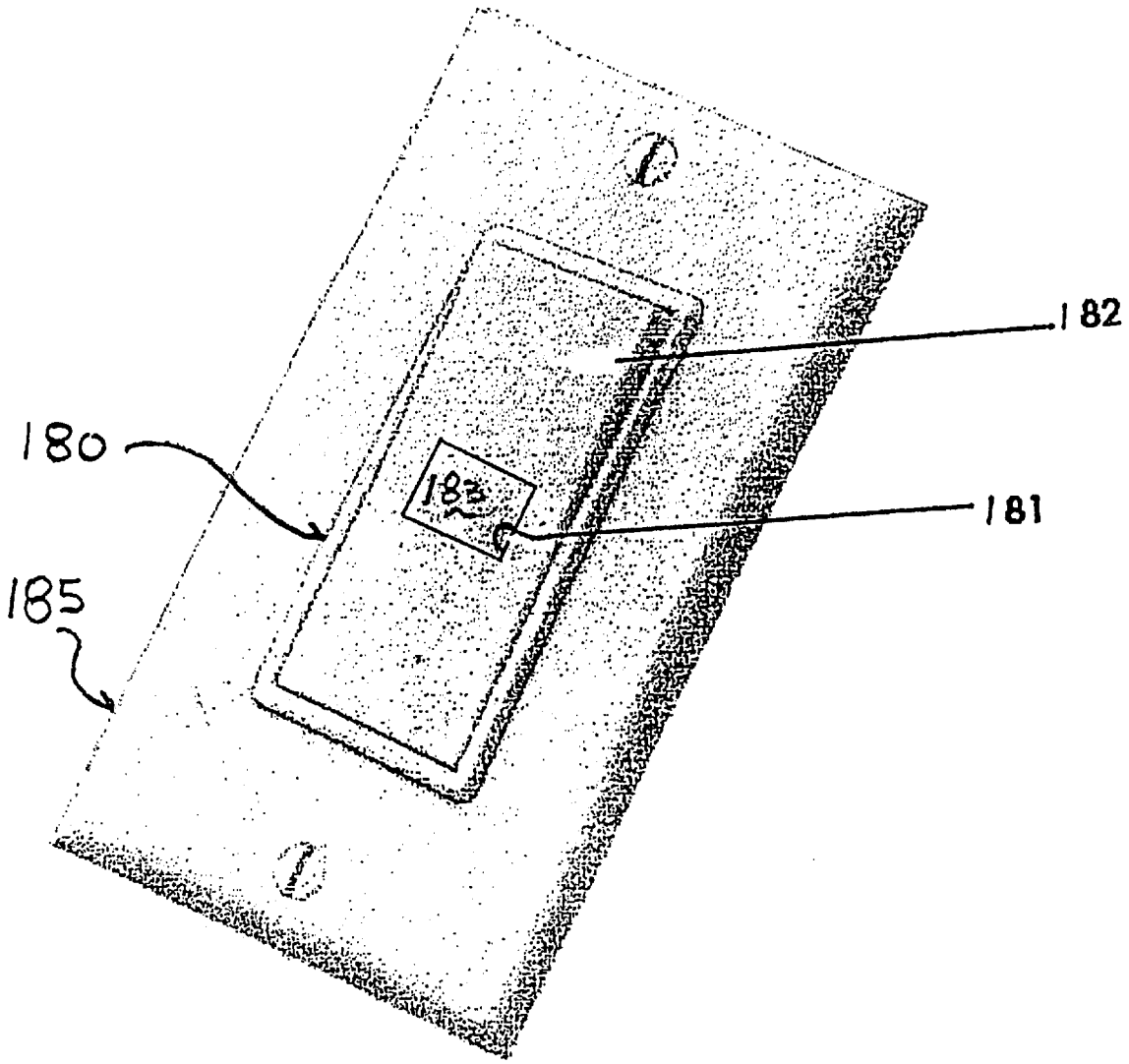
FIG. 17 is a diagram illustrating an exemplary embodiment of another aspect of the present invention wherein a traditional rocker switch includes a motion detector or occupancy sensor.

In another aspect, it is contemplated that an "occupancy sensor" feature can be added to a conventional electrical switch. The end result might be called an automatic switch as it has the traditional shape and appearance of a conventional electrical switch. For example, one type of conventional electrical switch shown in FIG. 17 includes an electrical switch 180 (a portion of which is exposed to ambient radiation) and a cover plate 185. The switch 180 can be configured to include a small entrance aperture 181 on the portion of the electrical switch that is moveable between an on position and an off position, such as rocker 182. The entrance aperture is configured to admit ambient radiation and may or may not be rectangular and may or may not be centered as shown in the figure. The entrance aperture may have a cover element 183 positioned over at least a portion thereof. The cover element may be any material translucent to ambient radiation and preferably lies substantially within the surface of the movable structure of the switch. In a particularly useful embodiment, the cover element is a lens array of one or more elements such as, for example, a fresnel lens array or an array of microlenses. For any desired field of view, range, and angular resolution the size of the entrance aperture depends on whether or not a pre-focusing lens is employed. With or without a pre-focusing lens, this configuration has the advantage of maintaining the familiar and well accepted rocker switch appearance and functionality while adding the functionality of an occupancy sensor. A novel feature of this embodiment is that the entrance aperture for the infrared radiation is on the movable portion of the standard switch configuration. Variations of this design could have one or more rocker switches mounted either vertically or horizontally and an entrance aperture for infrared radiation on or replacing one of the conventional switches. It is further contemplated that rather than being a rocker switch of the type shown in FIG. 17, any conventional switch configuration such as, for example, toggle switch, slide switch, etc., can likewise be modified to include an entrance aperture (with or without the use of pre-focusing lens array) to thereby provide an occupancy sensor feature. As those skilled in the art will appreciate, the use of microlenses may be required for switches having movable structures that include surfaces of small area.

While the present invention has been described in detail with reference to the preferred embodiments, they represent mere exemplary applications. For example, as those skilled in the art will readily appreciate, the systems described herein can be used in conjunction with other types of sensors (e.g., acoustic sensors) or with radio transmitters which send a signal or sound an alarm when motion is detected. Thus, it is to be clearly understood that many variations can be made by anyone of ordinary skill in the art while staying within the scope and spirit of the present invention as defined by the appended claims.

What is claimed is:

1. An infrared input section for motion detectors, occupancy sensors and other similar systems comprising:

a first lens array of one or more elements, at least one element being positioned to receive and at least partially focus incident infrared radiation;

a second lens array including a plurality of elements, at least one element being positioned to receive and focus the partially focused infrared radiation; and at least one detector positioned to receive the infrared radiation focused by the second lens array.

2. An infrared input section for motion detectors, occupancy sensors and other similar systems as in claim 1 wherein the first lens array includes one or more elements that focus incident infrared radiation directly onto at least one detector and one or more elements that partially focus incident infrared radiation onto one or more elements of the second lens array.

3. An infrared input section for motion detectors, occupancy sensors and other similar systems as in claim 2 wherein the first lens array is substantially flat and is positioned substantially flush with a front surface of the system.

4. An infrared input section for motion detectors, occupancy sensors and other similar systems as in claim 2 further comprising an intermediate lens array positioned between the first lens array and the second lens array.

5. An infrared input section for motion detecetors, occupancy sensors and other similar systems as in claim 1 wherein the first lens array is substantially flat and is positioned substantially flush with a front surface of the system.

6. An infrared input section for motion detectors, occupancy sensors and other similar systems as in claim 1 further comprising an intermediate lens array positioned between the first lens array and the second lens array.

7. An infrared input section for motion detectors, occupancy sensors and other similar systems as in claim 6 wherein at least one of the lens arrays includes one or more microlenses.

8. An infrared input section for motion detectors, occupancy sensors and other similar systems as in claim 6 wherein at least one of the lens arrays is a diffractive optics array.

9. An infrared input section for motion detectors, occupancy sensors and other similar systems as in claim 1 wherein at least one of the lens arrays includes one or more microlenses.

10. An infrared input section for motion detectors, occupancy sensors and other similar systems as in claim 1 wherein at least one of the lens arrays is a diffractive optics array.

11. An infrared input section for motion detectors, occupancy sensors and other similar systems comprising:

at least one mirror positioned adjacent to an infrared entrance aperture, the at least one mirror directing and optionally partially focusing incident infrared radiation;

a first lens array of one or more elements, at least one element positioned to receive and focus incident infrared radiation directed by the at least one mirror;

a second lens array including a plurality of elements, at least one element being positioned to receive and further focus infrared radiation focused by the first lens array; and at least one detector positioned to receive infrared radiation focused by the second lens array.

12. An infrared input section for motion detectors, occupancy sensors and other similar systems as in claim 11 wherein the at least one mirror is configured to focus incident infrared radiation directly onto the at least one detector.

13. An infrared input section for motion detectors, occupancy sensors and other similar systems as in claim 12 further comprising an intermediate lens array positioned between the first lens array and the second lens array.

14. An infrared input section for motion detectors, occupancy sensors and other similar systems as in claim 12 further comprising a clear cover element through which incident infrared radiation passes before being directed by the at least one mirror.

15. An infrared input section for motion detectors, occupancy sensors and other similar systems as in claim 14 the clear cover element comprises one or more lens elements.

16. An infrared input section for motion detectors, occupancy sensors and other similar systems as in claim 11 further comprising an intermediate lens array positioned between the first lens array and the second lens array.

17. An infrared input section for motion detectors, occupancy sensors and other similar systems as in claim 16 wherein at least one of the lens arrays includes one or more microlenses.

18. An infrared input section for motion detectors, occupancy sensors and other similar systems as in claim 16 wherein at least one of the lens arrays is a diffractive optics array.

19. An infrared input section for motion detectors, occupancy sensors and other similar systems as in claim 11 further comprising a clear cover element through which incident infrared radiation passes before being directed by the at least one mirror.

20. An infrared input section for motion detectors, occupancy sensors and other similar systems as in claim 19 wherein the clear cover element comprises one or more lens elements.

21. An infrared input section for motion detectors, occupancy sensors and other similar systems as in claim 11 wherein at least one of the lens arrays includes one or more microlenses.

22. An infrared input section for motion detectors, occupancy sensors and other similar systems as in claim 11 wherein at least one of the lens arrays is a diffractive optics array.

23. An infrared input section for motion detectors, occupancy sensors and other similar systems comprising:

a first lens array of one or more elements, at least one element being positioned to receive and at least partially focus incident infrared radiation;

at least one mirror positioned to reflect infrared radiation partially focused by the first lens array;

a second lens array including a plurality of elements, at least one element being positioned to receive and further focus infrared radiation reflected by the at least one mirror; and at least one detector positioned to receive infrared radiation focused by the second lens array.

24. An infrared input section for motion detectors, occupancy sensors and other similar systems as in claim 23 wherein the at least one mirror reflects incident infrared radiation directly onto the at least one detector.

25. An infrared input section for motion detectors, occupancy sensors and other similar systems as in claim 24 further comprising an intermediate lens array positioned between the first lens array and the second lens array.

26. An infrared input section for motion detectors, occupancy sensors and other similar systems as in claim 23 further comprising an intermediate lens array positioned between the first lens array and the second lens array.

27. An infrared input section for motion detectors, occupancy sensors and other similar systems as in claim 26 wherein at least one of the lens arrays includes one or more microlenses.

28. An infrared input section for motion detectors, occupancy sensors and other similar systems as in claim 26 wherein at least one of the lens arrays is a diffractive optics array.

29. An infrared input section for motion detectors, occupancy sensors and other similar systems as in claim 23 wherein at least one of the lens arrays includes one or more microlenses.

30. An infrared input section for motion detectors, occupancy sensors and other similar systems as in claim 23 wherein at least one of the lens arrays is a diffractive optics array.

* * * * *